United States Patent [19]

Griffith et al.

[11] 4,139,184

[45] Feb. 13, 1979

[54] GAS STIRRER

[75] Inventors: Cecil B. Griffith; Jerry D. Thomas, both of North Royalton; Thomas A. Wiktorowski, Parma Heights, all of Ohio

[73] Assignee: Republic Steel Corporation, Cleveland, Ohio

[21] Appl. No.: 805,912

[22] Filed: Jun. 13, 1977

[51] Int. Cl.[2] ..... C21C 7/00

[52] U.S. Cl. ..... 266/220

[58] Field of Search ..... 266/218, 220–224, 266/233, 236; 75/49, 61; 222/564, 591, 603, 607; 13/29, 30

[56] References Cited

U.S. PATENT DOCUMENTS

| | | | |
|---|---|---|---|
| 825,359 | 7/1906 | Snyder | 13/29 |
| 2,826,494 | 3/1958 | Drummond | 75/59 |
| 3,330,645 | 7/1967 | DeMoustier et al. | 266/220 |
| 3,501,290 | 3/1970 | Finkl et al. | 266/220 |
| 3,618,917 | 11/1971 | Fredrikson et al. | 266/220 |
| 3,721,432 | 3/1973 | Buhrer et al. | 266/236 |
| 3,737,153 | 6/1973 | Steffora et al. | 266/236 |
| 3,971,547 | 7/1976 | Fredrikson et al. | 266/236 |
| 4,004,793 | 1/1977 | Gray | 266/236 |

FOREIGN PATENT DOCUMENTS

| | | | |
|---|---|---|---|
| 106746 | 3/1943 | Sweden | 13/29 |
| 1192844 | 5/1970 | United Kingdom | 266/220 |

*Primary Examiner*—Gerald A. Dost

*Attorney, Agent, or Firm*—Watts, Hoffmann, Fisher & Heinke Co.

[57] ABSTRACT

A vessel, particularly a ladle, and method for mixing molten metal. The vessel is adapted to be used in an upright position and has bottom openings, including at least one first opening for the introduction of gas under pressure to stir the contents, and a second opening for discharging contents. A porous plug prevents metal from flowing through each first opening and a stopper controls discharge of metal through the second opening. The inside bottom surface of the vessel is sloped downwardly toward the first opening or openings and the entrance to the second opening is at a level above all first openings when the vessel is upright. The porous plug or plugs may be recessed with respect to the inside bottom surface. Any material that settles from the molten metal will tend to collect directly above a porous plug and become entrained in the stirred metal upon the introduction of gas.

2 Claims, 3 Drawing Figures

GAS STIRRER

BACKGROUND

1. Field of the Invention

This invention relates to a vessel that facilitates gas stirring of molten metal and a method of mixing in molten metal a material that tends to settle.

2. Prior Art

A variety of vessels are known for containing molten metal and facilitating the introduction of gas for a variety of purposes. See, for example, the U.S. Pat. Nos. 506,328 to Morris; Gesner 604,580; Langguth 1,169,270; Moore 1,763,248; Dreyfus 2,513,082; Drummond 2,826,494; Leroy et al. 2,975,047; Leroy et al. 3,062,524; Goedecke et al. 3,208,117; Andrzejak et al. 3,684,267; Andrzejak et al. 3,809,146; Shapland 3,825,241; and Voss 3,838,798.

Vessels such as those disclosed in the above referenced patents are not particularly suitable for specific use in mixing or stirring molten metal when material to be mixed tends to settle from the molten metal after being added but prior to being poured, as when dissolution is incomplete or slow, or for discharging molten metal from a bottom opening when undissolved material which should not be discharged may have settled. In particular, the vessels disclosed are not particularly suitable for gas stirring and mixing lead additions or the like, into steel. As the above prior art indicates, gas has been injected into molten metal to mix material on top of the metal bath in a furnace (U.S. Pat. No. 1,763,248), and alloying additions have been introduced as a gas through a porous plug (U.S. Pat. No. 2,826,494). Such structures fail to facilitate effectively mixing additions in a molten bath through gas stirring, where the additions tend to settle and must be re-entrained into the molten metal for further dispersion and/or dissolution.

SUMMARY OF THE INVENTION

The present invention relates to a vessel for gas stirring of molten metal and especially a vessel constructed to assure mixing with molten metal any material that tends to settle, i.e., undissolved constituents that are heavier than the molten metal. The vessel is constructed for use in an upright orientation and finds particular application in adding lead to steel to produce leaded steel.

A vessel is provided with a bottom and an upright surrounding wall. The bottom has at least one opening for the introduction of gas and another for the removal of molten metal from the vessel. Typically, the vessel is of refractory material, such as a metal shell lined with a refractory brick. The one or more openings in the vessel for the introduction of gas contain refractory porous plugs that prevent the outflow of molten metal. The opening for the discharge of metal has a mechanism for controlling flow, such as a vertically movable stopper rod.

The inside surface of the bottom of the vessel is sloped toward the one or more openings through which gas is introduced. If there is more than one such opening, the bottom surface is sloped so that the plural openings are all at a lowest portion of the inside bottom surface. In one preferred embodiment, the porous plug associated with an opening for introduction of gas is recessed in the bottom to provide a cavity for better collecting settled material directly above the opening for recirculation. The exterior of the vessel is constructed to facilitate the connection of a source of gas under pressure to the opening or openings through which gas is introduced.

The discharge opening is remote from the gas inlet opening or openings, and the interior end of the discharge opening is at a significantly higher elevation than the gas inlet or inlets. This avoids accumulation of any undissolved, settled, material from the molten bath at the outlet. Thus, not only is such material collected over the gas inlet or inlets and entrained in the stirred metal, but also it is collected at a location lower than the outlet so that any settled or undissolved material is not poured or discharged with the molten metal.

The above and other features and advantages of this invention will become more apparent from the detailed description that follows, when considered in connection with the accompanying drawings.

DETAILED DESCRIPTION

Figure 1:
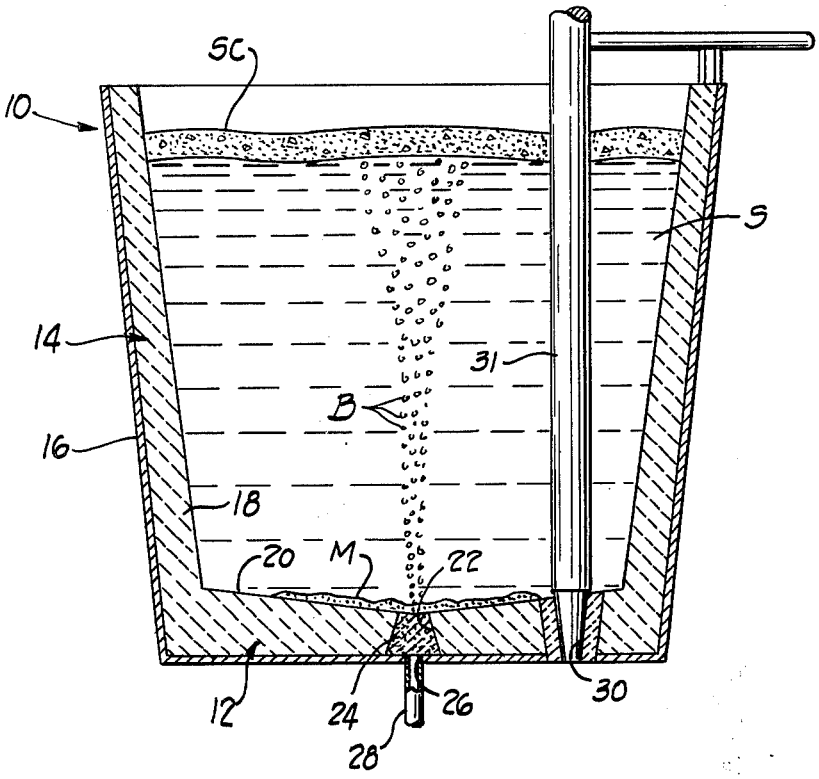
FIG. 1 is a vertical sectional view of a vessel embodying the present invention.
Figure 2:
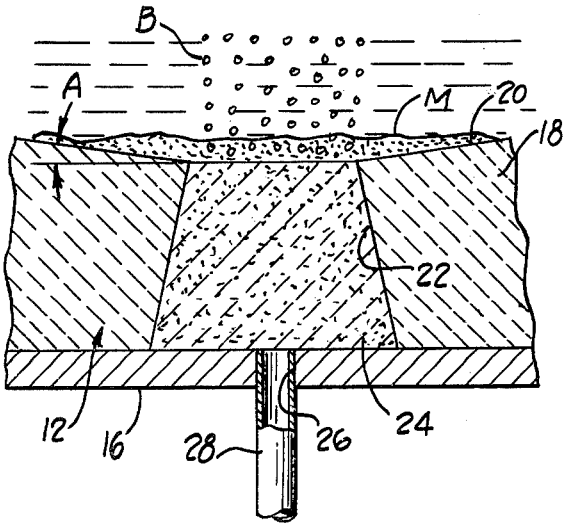
FIG. 2 is a partial vertical section on an enlarged scale of the porous plug and surrounding structure of the vessel shown in FIG. 1.
Figure 3:
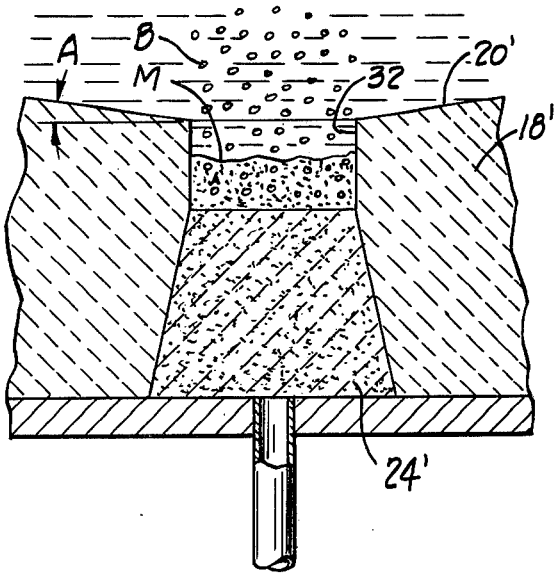
FIG. 3 is a vertical sectional view similar to that of FIG. 2, but illustrating a second embodiment of the invention in which a porous plug is recessed from the inside surface of the bottom of the vessel.

With reference to the drawings, a vessel 10 is shown in FIGS. 1–3, embodying the present invention. In a preferred form, the vessel 10 is a ladle for molten steel and comprises a bottom 12 and an upstanding surrounding wall 14. The construction as shown includes a steel shell 16 with a refractory lining 18, such as bricks. An inside surface 20 of the bottom lining 18 slopes downward from the surrounding wall 14 toward the center, where a first opening 22 is located for the introduction into the ladle of gas under pressure. Although in the embodiment shown the opening 22 is at the center of the bottom, it can be at other locations. The opening 22 is small relative to the total area of the ladle bottom and the surface 20 slopes in all radial directions toward the opening.

A porous plug 24 that is gas permeable and metal impermeable is located within the opening 22, and is of a depth equal to that of the immediately surrounding lining 18, terminating flush with the top or inside surface 20. The porous plug is in direct communication with an opening 26 in the steel shell. A pipe connection 28 communicates with the opening 26 on the exterior of the vessel or ladle 10, for facilitating connection with a source of gas under pressure.

The ladle bottom 12 has a second opening 30 in the form of a pouring nozzle through the lining 18, remote from the first opening 22. A vertically movable stopper rod 31 closes the opening when in its lowered position, shown in FIG. 1. The second opening 30 communicates through the lining 18 at the inside surface of the bottom of the ladle at a level significantly above the upper surface of the porous plug 24, when the ladle is upright as shown. In the preferred embodiment, this is accomplished by locating the second opening or pouring nozzle 30 adjacent the side wall 14 of the vessel so that the level of the inside entrance to the second opening is higher than the porous plug by virtue of the slope of the surface 20. The angle of the slope, indicated in FIG. 2 by the letter A, relative to the horizontal, is at least five degrees.

Both the refractory lining and the porous plug material may be any suitable material of a type well known in the art for satisfactorily performing the present functions.

A modified construction of the bottom lining of the ladle and porous plug is shown in FIG. 3. A porous plug 24' is recessed relative to the inside surface 20' of a lining 18' of the bottom 12' of the vessel. This construction provides a cavity 32 directly above the plug 24'. The inside surface 20' slopes downward from the surrounding sidewall of the vessel toward the cavity 32 at an angle A from the horizontal, which as in the embodiment of FIG. 2, is at least five degrees. Particles that settle from the molten bath in the vessel collect in the cavity 32, which has a capacity to accumulate particles directly over the porous plug, for maximum effect of returning the particles into the volume of molten metal through gas stirring.

In operation, a molten metal bath, such as molten steel S, is contained in the vessel 10 and a slag cover SC is conventionally applied. A material M to be added to the steel bath is then inserted by means suitable to the particular material. For example, in the case of a lead addition, finely divided lead can be added to the steel bath by temporarily parting the slag on the surface and depositing the lead directly on the surface, introducing it under the surface through a tube, or gunning the lead particles into the bath under force. When the material added is of greater density than the molten metal bath, as is the case when lead particles are added to a steel bath, particles that do not rapidly dissolve tend to settle to the bottom of the bath and collect on the bottom of the ladle or vessel. This is especially true where the solubility level of the added material is low and/or an amount in excess of that which is immediately dissolved is added. Such undissolved particles tend to collect in a mass of material M along the bottom of the ladle, above and adjacent to the porous plug 24, because of the slope of the inside surface 20 of the lining 18.

Gas is introduced under pressure through the one or more porous plugs, either before and during, or after the addition of the material. Bubbles B of gas rise to the top of the molten bath, stirring the metal as they rise, and thereby moving the settled material M upward and entraining it into the circulating metal bath, where the particles become dispersed and/or dissolved. Such dispersed, undissolved, particles may then settle again, drifting back to the location over the porous plug, for recirculation.

After stirring, the gas flow is stopped, the stopper rod 31 is raised, and molten metal in which the added material is dissolved or dispersed is discharged through the opening 30. Any undissolved particles of added material collected over the porous plug 24 are at a lower level than the discharge nozzle opening 30 and therefore do not flow through the opening, but rather are retained in the bottom of the vessel. This prevents undissolved or undispersed material from finding its way into a billet, casting or other product formed from the molten metal, in which the material would be nonuniformly distributed or in excess concentration. Thus, the construction of this vessel reduces the need for and waste from bottom cropping of billets when leaded steel is produced and helps assure a more uniform and controlled product from the molten bath.

While preferred embodiments of the present invention have been described in detail, it will be apparent that modifications or alternations may be made therein without departing from the spirit and scope of the invention set forth in the appended claims.

What is claimed is:

1. A bottom-pour transport ladle especially useful for inert gas stirring to mix materials into molten metal, which materials tend to settle when undissolved, said ladle having a steel shell and a refractory lining that define a bottom and an upright surrounding wall, a first opening through a portion of the bottom of the steel shell surrounded by the upright wall, a gas-permeable plug in the refractory lining over said first opening and substantially smaller than the bottom of the ladle, said refractory lining defining an interior surface to the bottom of the ladle that slopes downward toward said plug so that materials that settle from the metal within the ladle will tend to collect over the plug, a second opening through both the steel shell and the refractory lining of the bottom of the vessel surrounded by the upright wall, said second opening defining a pouring nozzle that opens into the interior of the ladle through said sloped surface at a higher level than the interior surface of the plug, said ladle being constructed to pour while upright, and means to control discharge from said second opening.

2. A ladle as set forth in claim 1, wherein said refractory lining defines a recess in the sloped interior surface of the bottom of the ladle and wherein said plug is located in the recess, below said sloped interior bottom surface.

* * * * *